US007959008B2

(12) United States Patent
Von Campe et al.

(10) Patent No.: US 7,959,008 B2
(45) Date of Patent: Jun. 14, 2011

(54) METHOD AND DEVICE FOR SCREENING OUT PARTICLES

(75) Inventors: Hilmar Von Campe, Bad Homburg (DE); Werner Buss, Hanau (DE)

(73) Assignee: Schott Solar AG, Alzenau (DE)

( * ) Notice: Subject to any disclaimer, the term of this patent is extended or adjusted under 35 U.S.C. 154(b) by 231 days.

(21) Appl. No.: 12/289,714

(22) Filed: Oct. 31, 2008

(65) Prior Publication Data

US 2009/0134073 A1 May 28, 2009

(30) Foreign Application Priority Data

Nov. 2, 2007 (DE) ..... 10 2007 052 473

(51) Int. Cl.
*B07B 1/28* (2006.01)

(52) U.S. Cl. ..... 209/309; 209/263; 209/311; 209/325; 209/392; 209/658

(58) Field of Classification Search ..... 209/263, 209/309, 311, 312, 313, 325, 392, 397, 401, 209/658, 659
See application file for complete search history.

(56) References Cited

U.S. PATENT DOCUMENTS 2,053,038 A * 9/1936 Mackenzie ..... 209/355
2,329,773 A * 9/1943 Leahy ..... 209/310
4,194,970 A * 3/1980 Clem ..... 209/263
4,806,235 A * 2/1989 Mueller ..... 209/321
4,875,999 A * 10/1989 Haight ..... 209/245
6,763,948 B2 * 7/2004 Ballman et al. ..... 209/320

FOREIGN PATENT DOCUMENTS

DE 195 26 841 10/1996

* cited by examiner

*Primary Examiner* — Terrell H Matthews

(74) *Attorney, Agent, or Firm* — Dennison, Shultz & MacDonald

(57) ABSTRACT

The invention relates to a method and a device for screening first particles out of a granulate comprised of first and second particles by conveying the granulate along a first screen surface which extends outward from a vibrating device, wherein the first particles have an aspect ratio $a_1$, with $a_1>3:1$, and the dimensions of the second particles allow them to fall through the mesh of the first screen surface. To screen a certain material fraction which differs geometrically from the remainder of the material in terms of at least one dimension out of the granulate, it is proposed that the granulate be conveyed along the screen surface between said surface and a cover which extends along the screen surface, and that the cover should cause the first particles to be aligned with their longitudinal axes extending along the screen surface, wherein the longitudinal extension of each first particle is greater than the mesh width of the screen which forms the first screen surface, and the longitudinal extension of the second particles is equal to or less than the mesh width.

30 Claims, 7 Drawing Sheets

Material Fraction

METHOD AND DEVICE FOR SCREENING OUT PARTICLES

Figure 1A:
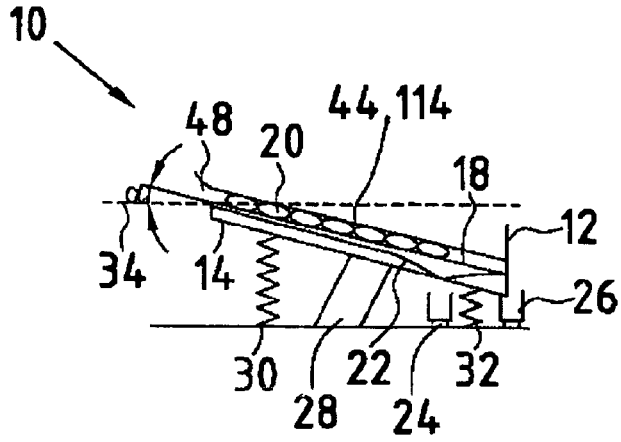

The invention relates to a method for screening first particles out of a granulate comprised of first and second particles by conveying the granulate along a first screen surface, wherein the first particles have an aspect ratio $a_1$, wherein $a_1$>n:1, with n=2, 3, >3, and the dimensions of the second particles allow them to fall through the mesh of the first screen surface, wherein the granulate is conveyed along the screen surface between this surface and a cover which extends along the screen surface, and the cover causes the first particles to become aligned with their longitudinal axes extending along the screen surface, wherein the longitudinal extension of each first particle is greater than the mesh width of the screen which forms the first screen surface, and the longitudinal extension of the second particles is equal to or smaller than the mesh width.

In the semiconductor industry, crystals are drawn from a melt, for example. One example of this is the Czochralsky, or Edged-Defined-Sheet-Fed Growth—method (EFG method). Particularly in this method, it is necessary for particles to be continuously fed to the melt in the same amount as material is being removed from the melt by the growing crystals.

The particles, which form a granulate, are fed to the melt via tubing. In this process, it must be ensured that a largely geometrically homogeneous granulate is conveyed, in other words especially elongated particles having an aspect ratio>3:1 are removed, as these can otherwise become suspended in the tubing, causing it to become clogged.

Cascading series of screens can be used to remove needle-like particles, in which case three screen troughs are ordinarily arranged one above another. The troughs, positioned so as to slope, are placed in vibration, wherein the ejection end of each respectively upper trough projects beyond the starting end of the trough beneath it, viewed in the direction of conveyance, so that the elongated particles are ejected and cannot fall into the subsequent trough. In contrast, the regularly shaped particles fall through the screen mesh from screen trough to screen trough. The disadvantage of this method is that smaller particles such as dust also fall through the screen mesh, so that dust is not filtered out. Due to purity requirements, however, dust must be prevented from reaching the melt, as it is disproportionately contaminated because of the large total surface. A further disadvantage is that the dust that falls through the screen mesh also contaminates the larger particles.

Another known method for screening out elongated particles involves the use of drum screens, which rotate around cylindrical axes to separate oversized needles from the granulate. If the drum axis is tilted slightly, these can then slide out of the interior area of the drum axis.

Additionally, overlength separators for screening out overlengths, linkages and agglomerates from plastic granulates are known. In such devices, needle-like particles are prevented from being turned upright by a very flat throw angle.

The methods employed according to the prior art are capable only of incompletely screening out elongated or needle-like particles, because they do not prevent some needle-like particles from being accidentally and temporarily turned upright, which allows them to fall through the mesh of the screen.

To achieve an effective removal of dust, the process of whirling up the granulate is known, wherein the dislodged dust is thrown off and then suctioned or blown off. In this process, the particles of granulate are whirled together and are thrown with a high level of kinetic energy against the boundaries of the device holding the particles, in other words its walls. This, in turn, results in the development of dust and a contamination of the granulate as a result of abrasive wear.

One method of the type initially described is found in DE-C-195 26 841. To separate at least two fractions of a mixture of solid materials comprised, for example, of combined construction waste and foreign materials such as plugs, which are different in terms of particle shape, this mixture is conveyed along a screen surface which has a mesh width that will allow one of the fractions to pass through. A cover plate or a link chain is positioned spaced somewhat from the screen surface, to prevent the longer particles of one of the fractions from being turned upright, so that they cannot fall through the screen surface. The distance between the cover plate and the screen surface can be adjusted to achieve optimization with respect to this spacing. Tests are conducted for this purpose.

One method for screening materials is described in U.S. Pat. No. 4,194,970. In this method, a screen surface is used which extends inclined at an angle, preferably between 45° and 60° from horizontal.

The object of the present invention is to screen a specific material fraction out of a granulate or granulate mixture, wherein said fraction differs geometrically from the remainder of the material in at least one dimension. In particular, first needle-like particles having an aspect ratio (length to width) of at least greater than 2:1, especially ≧3:1, are to be screened out of the remainder of the material. A further aspect of the invention provides that the granulate from which the first particles have been removed is low in dust, wherein contaminants are prevented from being introduced during screening as a result of the abrasion of the material of the device being used to implement the screening.

With respect to the process, the object is attained substantially in that a sheet, which rests on the particles by virtue of gravitational force, or a plate is used as the cover, which is capable of pivoting around an axis which extends transversely to the direction of transport of the granulate on the first screen surface, such that a gap which extends between the first screen surface and the cover is adjusted based upon the size and/or shape of the particles.

According to the invention, adjustment to the first particles to be aligned along the screen surface is self-regulating, thereby ensuring that the desired separation between the first and second particles occurs even in the event of fluctuations in their aspect ratio, a possibility that is not offered by the prior art in which a plate is used as the cover. It is also necessary according to the prior art for the distance between the cover and the screen surface to be determined through tests, so that the desired separation can be implemented. But even suspended chains do not offer this possibility, as these can move in the direction of transport of the particles, so that as a result, the particles that should not be screened out cannot necessarily be prevented from being turned upright. Moreover, the suspended chains can be spaced from one another, making it possible for the chains to fail to collect particles that should not be screened out, allowing them to be turned upright.

According to the teaching of the invention, it is ensured that elongated particles present in the granulate, as the first particles, cannot be "erected," so that they do not fall through the mesh of the screen. Instead, the mesh width is structured in such a way that only the second particles, which especially have an aspect ratio of ≦3:1, fall through the mesh.

Regarding the aspect ratio a1 of the first particles, it should be noted that this can be a1>n:1, with n=2, 3 or greater than 3 accordingly, wherein the aspect ratio can be adjusted to the respective case.

In this case, aspect ratio refers to the ratio of the length of the particles to their width. Independently of this, in principle, another criterion for screening out the first particles is that the length of the first particles is greater than 5 mm. Shorter particles whose aspect ratio is also greater than 3:1 are not to be characterized as first particles in the sense described above. The length of more than 5 mm in this connection is not a fixed dimension, but can be varied based upon the material of the granulate or the requirements with respect to the conveyance properties through a system of tubes.

Very generally, it is proposed according to the invention that the cover which extends along the screen surface ensures that a material fraction which differs geometrically in its longitudinal extension from the remaining particles is screened out, because the cover prevents the corresponding particles from being turned upright, so that they cannot fall through the mesh of the screen.

The method of the invention is particularly applicable for use with crushed silicon blanks, which in turn have been deposited at high temperatures from a fluidized bed via the gas phase deposition of silane at a temperature of between 600° C. and 900° C., or of trichlorosilane at a temperature of 1000° C. to 1350° C. in reduced hydrogen. The polysilicon produced in this manner is crushed. Based upon the predetermined structure of polysilicon, the particle shape of the material is elongated, with an approximately circular cross-section (approximately needle-shaped), wherein ordinarily only very few needle-like particles are contained in the total quantity. However, these must be completely removed, in order to prevent, as mentioned, interference during transport through a system of tubing.

But the invention is not limited to crushed polysilicon materials. Wafer scrap used for crystal growth can also be screened out accordingly, wherein, as mentioned, the aspect ratio results from the length of the wafer scrap pieces to their width, which the wafer scrap piece has perpendicular to the plane spanned by the screen, during its transport on said screen.

Very generally, according to the teaching of the invention, granulates comprised of semiconductor material such as silicon, germanium, GaAs, GaP, CdS, CdTe, $CuInSe_2$ and other compound conductors of the III-V, II-VI types, but also materials such as $SiO_2$ as the base material for the production of quartz, glasses, and ceramic materials such as SiC, $Al_2O_3$, $Si_3N_4$ and other materials, which are to be processed as granulate, are divided through screens into a product fraction and a fraction whose particles have an undesirable aspect ratio.

The considerations presented above also apply to the screening out of metallic overlengths, and to needle-like metallic particles, for instance needles, nails and screws. To this extent, the invention also extends to corresponding parts.

In the crushing of materials such as polysilicon, abrasion can produce contaminants. In this case, the contaminants are deposited on the surface, so that a contamination in proportion to the relevant surface occurs. Therefore, according to a further aspect of the invention, it must be ensured that dust that is created during the crushing process, the particle size of which is ordinarily <10 μm, is not removed via screening, as otherwise there is a danger that the dust will adhere to the larger particles. The invention therefore provides that particulate removal is performed prior to the actual screening process. To accomplish this, a second screen of smaller mesh width can be connected upstream from the first screen. Mesh widths of between 0.3 mm and 1 mm are particularly preferable.

It has been found, however, that merely screening out dust is insufficient. It is therefore proposed according to the invention that a suctioning device be positioned over the second screen, which has a mesh width of preferably between 0.3 mm to 1 mm, especially between 0.5 mm and 0.8 mm, with said suctioning device extending above or below the screen. Suctioning is preferably performed from the upper side of the screen, in order to prevent larger particles from clogging the mesh during suctioning from the underside of the screen.

Suctioning is especially performed using a large suctioning cross-section, so that the screen is covered over its entire width. Moreover, the extension along the longitudinal axis of the screen, in other words in the direction of the transport path, should be a×b, wherein, 5 cm≦a≦1, with 1=the screen length and b=the screen width. The greater a is, the better the removal of loosened miniature particles, and the lower the probability that granular particles of the product fraction, in other words those having a size that is desired for further processing, will also be suctioned off.

Preferably, and to achieve effective suctioning, it is provided that the granulate is made to fall vertically in front of the suctioning nozzle or opening. In this case, the flow of suction can be selected such that the particles of the product fraction, especially those having a particle size with an average diameter of between 0.3 mm and 0.5 mm, are not suctioned off, whereas microscopic particles (≦0.3 mm) are collected by the suction flow and therefore are suctioned off.

The granulate from which the dust has been removed in this manner then reaches the first screen, on which the first particles are screened off. In this case, the screen should be positioned above the closed base surface of a vibrating screen trough, which is placed in vibration especially by a magnetic vibrator. According to the invention, the screen or the screen mesh that forms the base, which should be made of plastic in order to prevent the abrasion of metal, is topped with a cover such as a sheet, which can be between 50 μm and 1 mm thick, especially in the range of 500 μm. The particles reach the space between the cover, in other words the sheet, and the screen or the screen mesh via an intake opening. Evenly shaped particles can fall through the screen mesh, whereas the cover causes the elongated particles to become aligned with their longitudinal axes along the plane spanned by the screen, which prevents them from being turned upright and falling through the screen. In this manner, elongated particles can be effectively screened out, so that even individual particles in very small quantities of 1% by weight, for example, can be reliably screened out of the total quantity. The elongated particles fall out of the screen trough at the end of the screen and can be gathered in a separate container and collected.

Instead of a sheet, which acts in a self-adjusting manner because it rests on top of the particles being conveyed along the screen by vibration by virtue of gravitational force, a plate can also be used as the cover, which is between 2 mm and 4 mm thick, for example, and is inherently rigid. A plate of this type is mounted so as to be capable of pivoting around an axis, which extends transversely to the direction of transport and above the intake area of the screen trough.

In this case, the plate is curved at the intake side so as to form a funnel-shaped opening for the infeed of the granulate.

The pivotably mounted plate is also capable of automatic adjustment.

The screen which screens out the first particles is preferably inclined in relation to the horizontal, wherein the screen intake is at a higher point than the end.

Especially, the surface or plane spanned by the screen forms an angle $\alpha$ of $0° \leqq \alpha \leqq 60°$ with the horizontal, with the preferred value range lying between 0° and 20°. Depending upon the angle of inclination $\alpha$, plate-shaped elongated particles, for example, can also be screened out, by structuring the screen as a perforated sheet with rectangular gaps. Based upon the angle α, the transport speed can also be increased.

According to the invention, a method for obtaining a pure granulate which is free of elongated particles, especially using a combination of screening process and dust removal, can be provided, wherein the elongated particle screening process of the invention is performed after dust has been removed.

A device for screening out particles having a predetermined longitudinal extension x, comprising at least one first screen, which spans a surface and which has a mesh width y, is characterized in that the screen having the mesh width y, with y<x, is topped by a cover at a gap distance Δs, with Δs<x, and in that the path of transport of the particles extends between the screen and the cover. In this case, the cover can rest independently on the particles being conveyed on the screen, by virtue of gravitational force.

The cover can be a sheet, with a thickness of between 100 μm and 3 mm, especially in the range of 500 μm to 1 mm. The surface weight should lie between 5 mg/cm$^2$ and 150 mg/cm$^2$.

The sheet may also be a fluid-filled sheet. This offers the advantage that the weight of the "sheet" can be easily adjusted and can be placed on top of the particles to be screened.

Alternatively, it is possible for the cover to be an inherently rigid plate. In this case, the cover is fastened so as to pivot around an axis which extends above the transverse edge of the screen at the intake side.

In a further important embodiment of the invention, it is provided that a second screen having a mesh width z, with z<y, is positioned upstream from the first screen. The mesh width y of the first screen should be between 2 and 5 mm. The mesh width z of the second screen should preferably be between 0.3 mm and 1 mm, especially between 0.5 mm and 0.8 mm.

To suction off particulate matter, such as dust, a suctioning device should be situated above and below the second screen. Especially, a suctioning device is provided above the screen, with suctioning extending over the entire width of the screen. Preferably, it is provided that the cross-section of the screen-side opening of the suctioning device extends to a×b, with 5 cm≦a≦1, with 1=the screen length and b=the screen width.

The first and/or second screen should be connected to a vibrating device, which can have a magnetic vibrator. In this case the first and/or second screen can form the base of a screen trough, wherein the first screen and the second screen are optionally sections of a single screen trough. The screen or the screen trough can also be mounted on a vibrating conveyor.

In a further embodiment of the invention, it is provided that the granulate to be screened out is made to fall past a suction opening before being placed on the first screen, in order to achieve a thorough removal of dust.

Further details, advantages and characterizing features of the invention are described not only in the claims and the characterizing features specified therein—alone and/or in combination—, but also in the following description of preferred exemplary embodiments illustrated in the set of drawings.

Figure 1B:
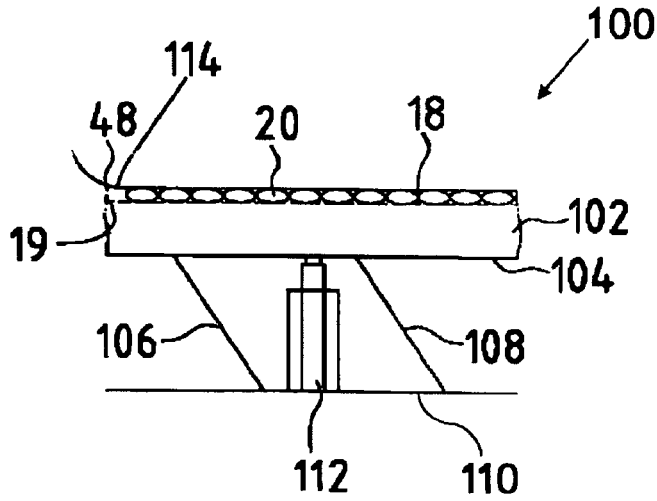
Figure 2:
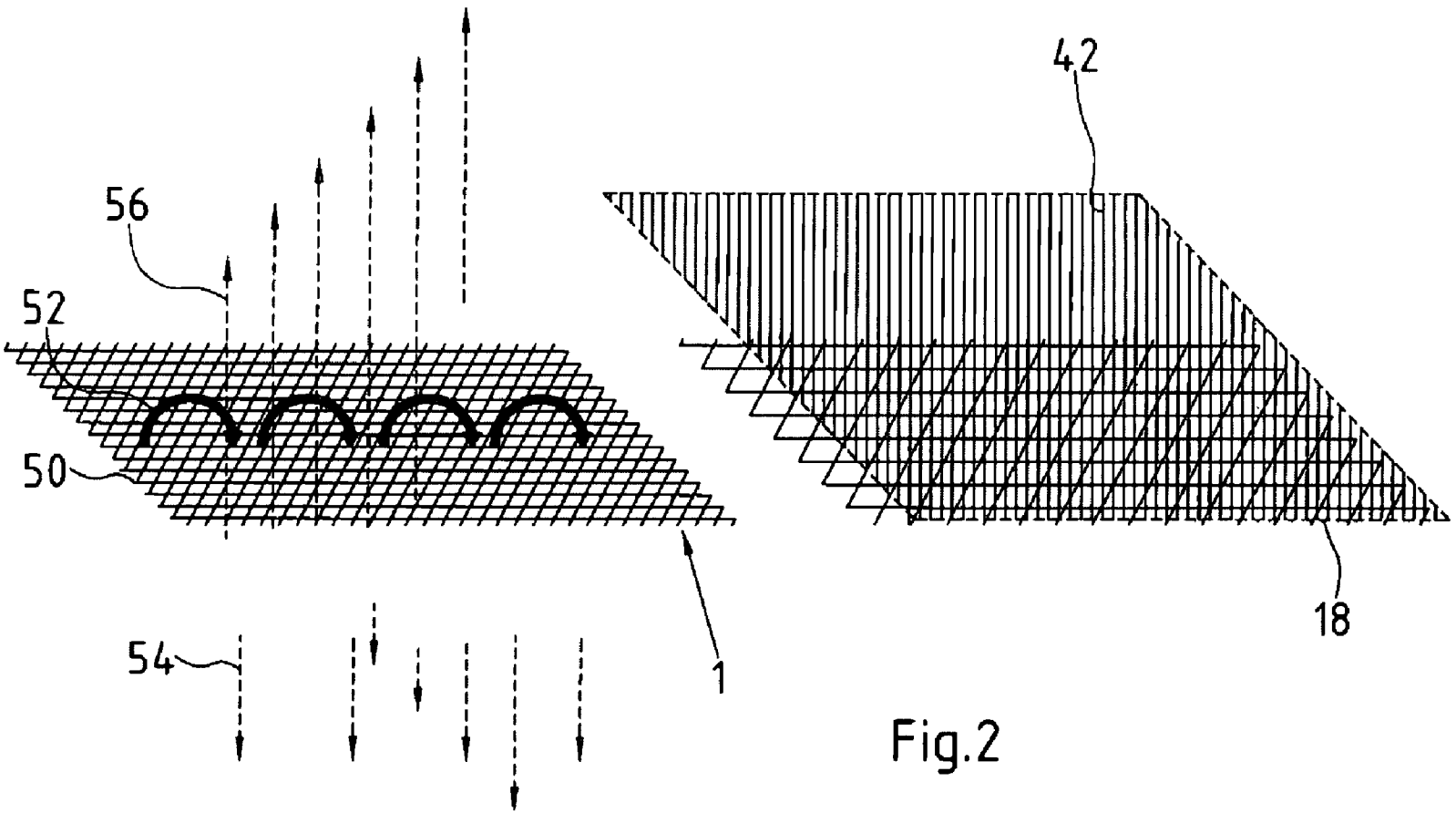
Figure 3:
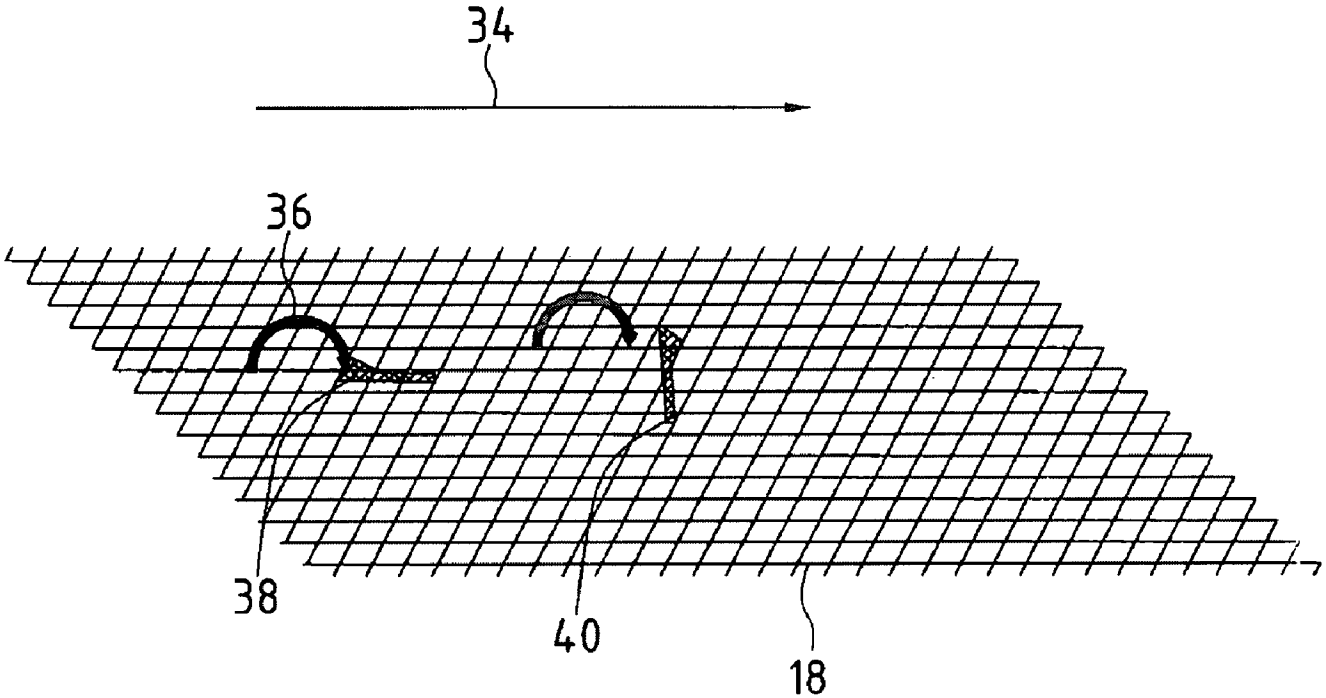
Figure 4:
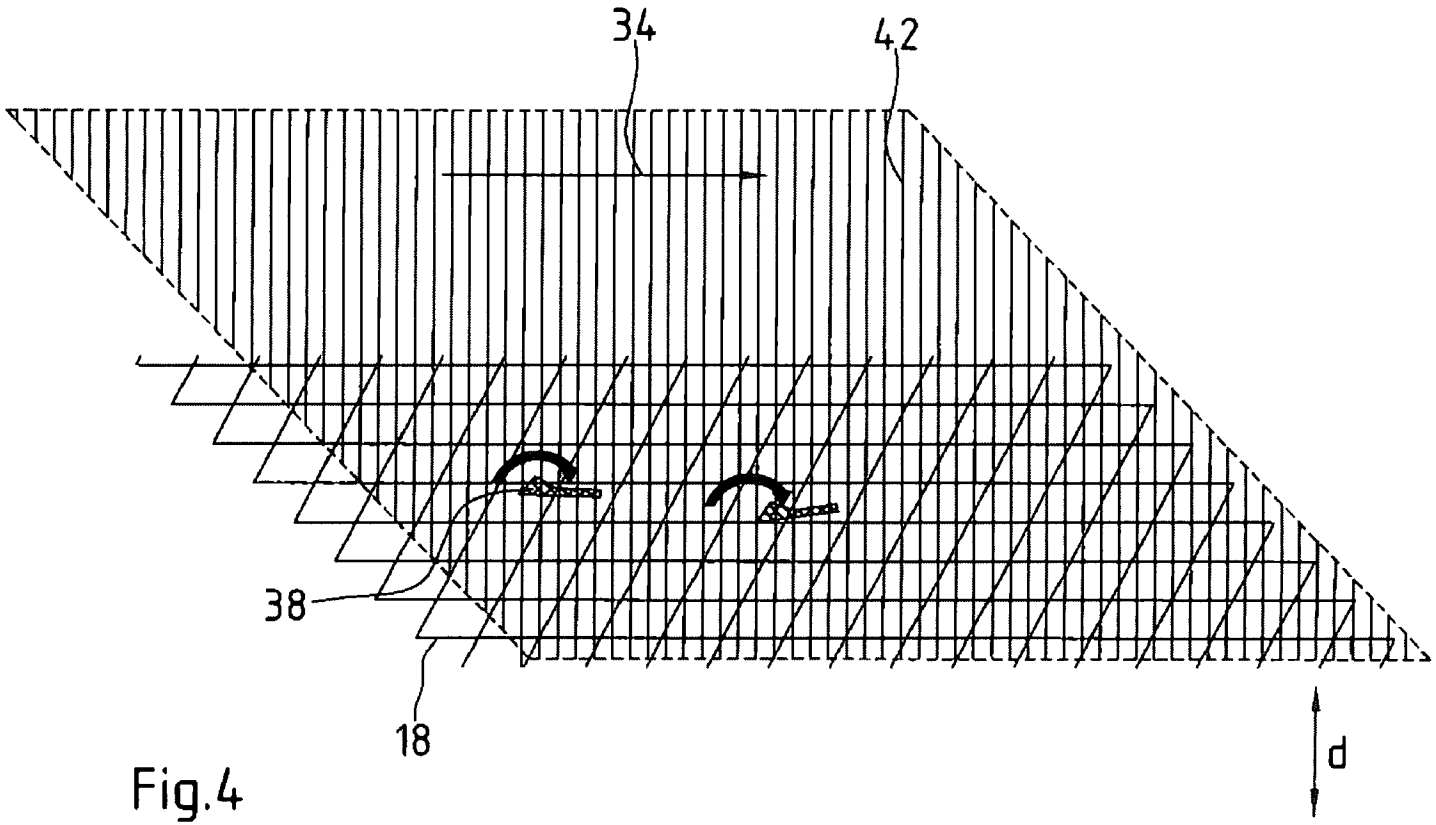
Figure 5:
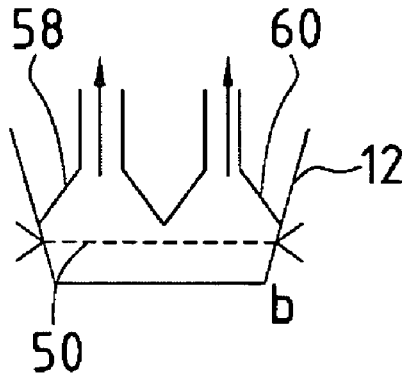
Figure 6:
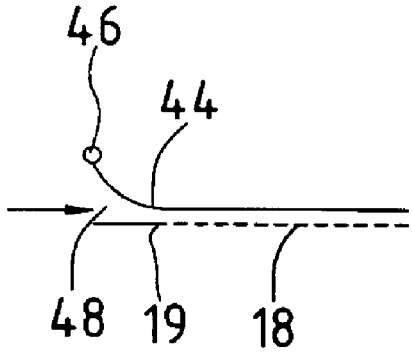
Figure 7:
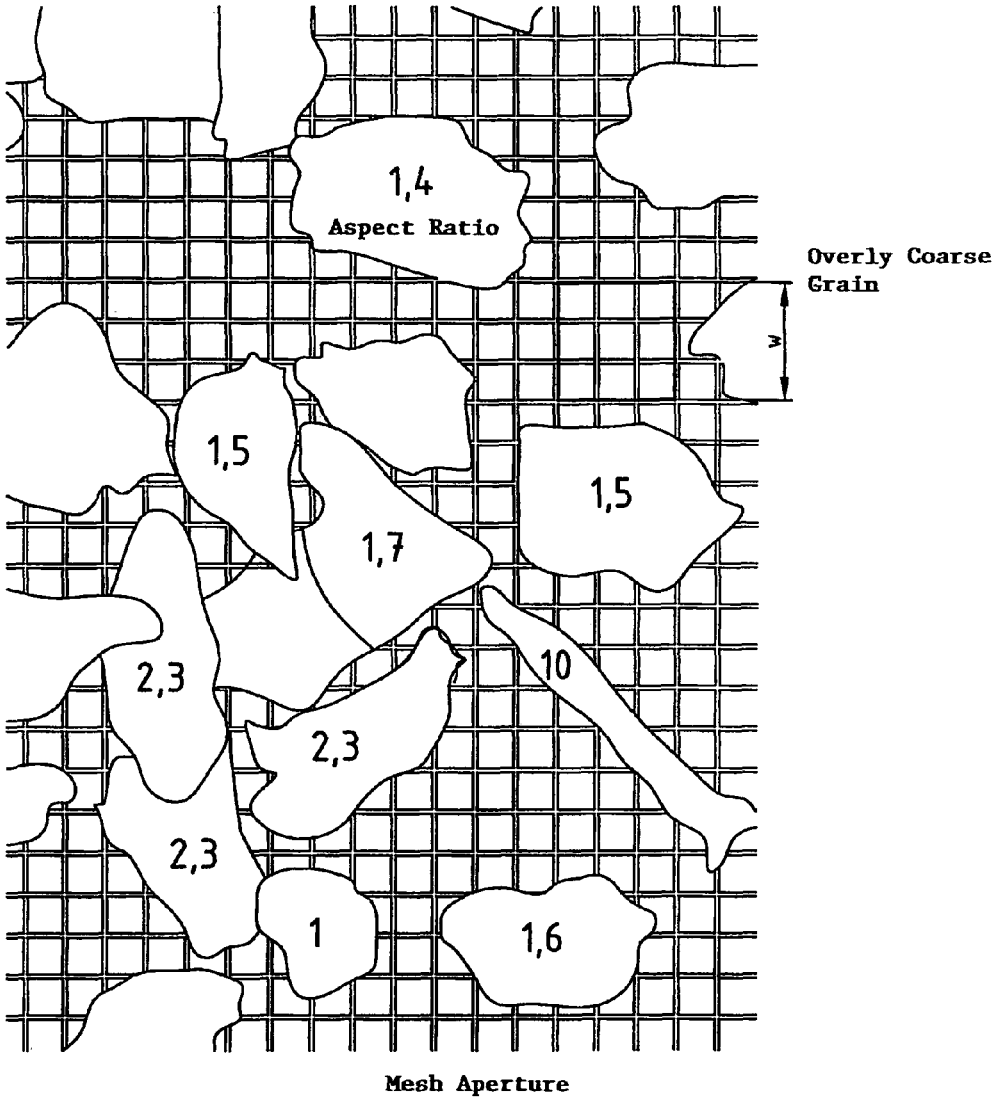
Figure 8:
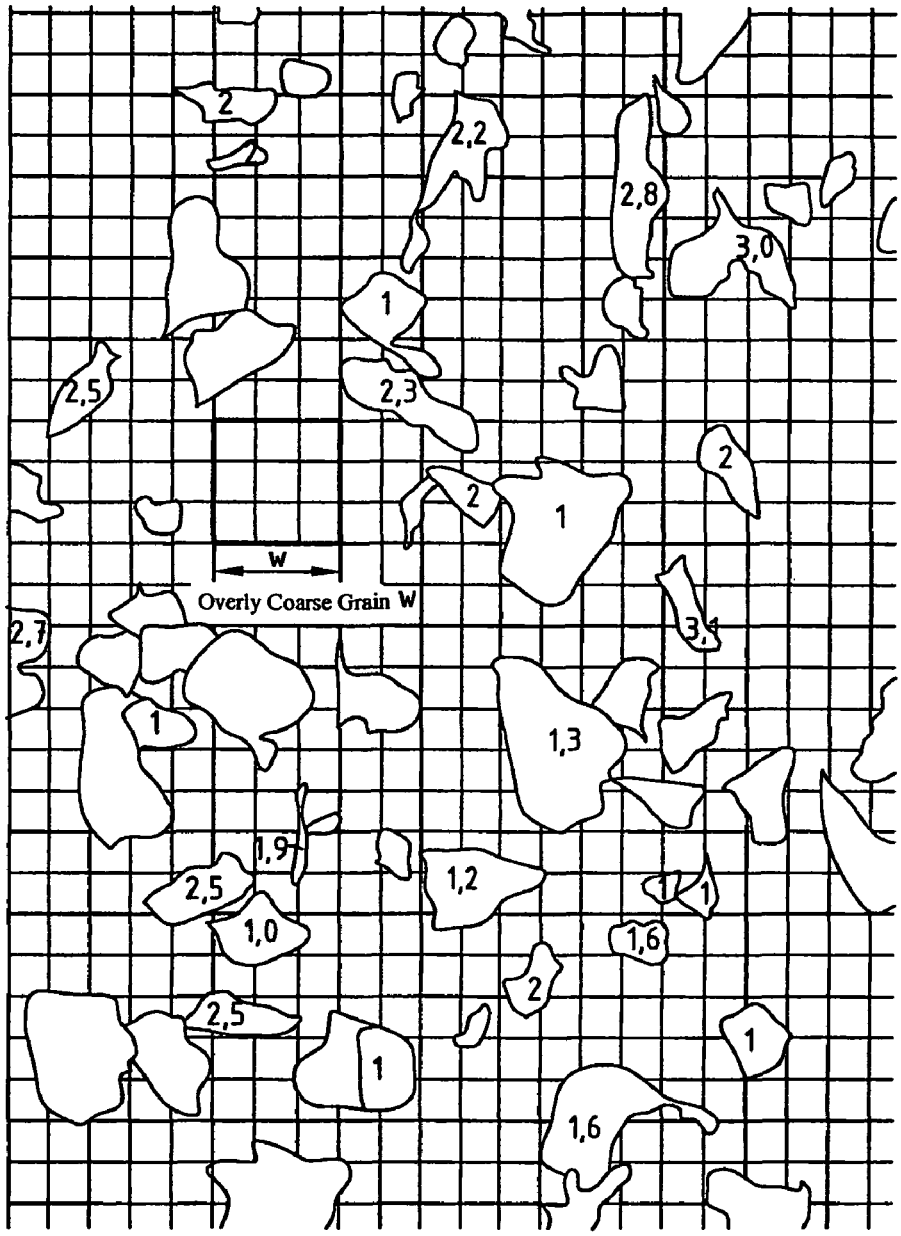

The drawings show:

FIG. 1*a* a schematic representation of a first embodiment of a screening device, FIG. 1*b* a schematic representation of a second embodiment of a screening device, FIG. 2 a schematic representation of the screening out of particles, FIG. 3 a schematic representation of particles moving on a screen, FIG. 4 a schematic representation of the method of the invention, FIG. 5 a section of one embodiment of a screening device, FIG. 6 a schematic representation of a screen with a cover, FIG. 7 a representation of elongated particles that have been screened out and FIG. 8 a representation of the product fraction that has been screened out.

Referring to the schematic representations found in the figures, the teaching of the invention, by which one or more desirable material fractions can be screened out of or removed from a granulate or granulate mixture, will be described in greater detail. The goal of this is to obtain a fraction (product fraction) whose particles have a geometrically equal geometry within preset dimensions, wherein dust particles and particles whose aspect ratio is greater than 3:1 are removed (FIG. 7). In principle, particles which are shorter than 5 mm should also be allocated to the so-called product fraction if their aspect ratio is greater than 3:1 (FIG. 8).

With regard to FIGS. 7 and 8, it should be noted that the figures assigned to the particles indicate their aspect ratio.

The granulate or granulate mixture is especially crushed polysilicon material, which has been deposited from the gas phase from trichlorosilane in reduced hydrogen, however, this does not constitute a restriction of the teaching of the invention. The corresponding particles are flat to cylindrically symmetrical in shape. The crushed material will be fed to a melt, for example, for drawing crystals. This is accomplished via tubing, which may have bends and corners. It must therefore be ensured that particles which do not meet the above-described secondary conditions are removed from the granulate, because otherwise the danger exists that the particles may become caught in the tubing, thereby clogging it.

Even though, as mentioned, the method of the invention is preferably intended for crushed polysilicon blanks, this should not be viewed as a restriction of the teaching of the invention. Instead, the invention relates very generally to granulates of semiconductor material such as silicon, germanium, GaAs, GaP, CdS, CdTe, $CuInSe_2$ and other compound semiconductors of the III-V, II-VI types, but also to materials such as $SiO_2$ as the base material for the production of quartz, glasses, and ceramic materials such as SiC, $Al_2O_3$, $Si_3N_4$ and other materials, which are to be processed as granulate. Needle-like metal pieces or particles can also be removed.

To separate granulate, i.e., the particles that make up the granulate, into the desired fractions, the granulate is fed into a vibrating trough 10, which has a housing 12 which is placed in vibration, and which comprises a screen 18, spaced somewhat from the base wall 14, which spans a plane. The granulate, in other words the particles 16, 20, schematically illustrated in FIG. 1, is conveyed over the screen 18, which is made of plastic, in order to implement a desired separation of fractions of the type described below. Below the screen 18 is a funnel 22, which opens into an opening, below which a receptacle 24 for the particles which pass through the screen 18 is positioned. At the ejection side, in other words at the lower end of the screen 18, is a second receptacle 26, in which the particles which do not pass through the screen 18 are collected. These are the previously described particles having an aspect ratio>3:1.

The vibrating device 10 according to FIG. 1*a* has a magnetic vibrator 28, which is connected to the housing 12 and places it in vibration. The housing 12 can be supported on springs 30, 32, represented here schematically, on a base.

In the exemplary embodiment, the screen 18 extends at an angle α from the horizontal (line 34), which measures between 0° and 60°, preferably in the range of 0° to 20°. In this case, the intake point lies above the ejection area.

In FIG. 3, a section of the screen 18 is illustrated schematically. The direction of transport of the particles on the screen is indicated by the arrow 34.

By placing the screen 18 in vibration, the particles are moved approximately in trajectory parabolas 36, whereby elongated particles 38 are turned upright (representation 40) and are therefore able to fall through the mesh of the screen 18. If the particle 38 is of a type having the aspect ratio that is to be avoided, with a length that is greater than the mesh width, then the previously described disadvantages which occur during transport of the fraction of particles which pass through the screen 18 and which have a maximum longitudinal extension that is smaller than the mesh width can result. Especially in the case of polysilicon, these particles have an aspect ratio of <3:1.

To prevent the particles 38 from being turned upright, the invention provides for a cover 42 to extend above the screen 18, which ensures that the particles 38 cannot be erected, as is shown in FIG. 4.

The particles of the granulate are conveyed along the screen between the cover 42 and the screen 18 (arrow 34), without risk of the particles having an aspect ratio>3:1, which are also characterized as elongated particles, being turned upright enough that they can pass through the mesh of the screen 18.

The cover 42 is a thin sheet 114, which is between 50 μm and 3 mm thick, for example. The particles to be screened out pass between the sheet 42 and the screen 18, wherein evenly shaped particles having a maximum longitudinal extension that is smaller than the mesh width fall through the screen mesh. In contrast, the elongated particles are prevented by the cover 42 from being turned upright and falling through the screen 18.

Structuring the cover as a sheet 114 results in the advantage that the distance between the sheet, in other words the cover 42, and the surface of the screen is adjusted automatically to the shape of the particles or their size, so that an optimum screening is possible. The sheet can also optionally be filled with a fluid, and can be a quasi-flexible flat pocket or pouch, in order to achieve a desired weight with which the sheet rests on the particles.

There is no danger of clogging, because the sheet 114 is able to yield to larger particles, a feature not offered by fixed plates. If desired, an additional force can act on the sheet, in addition to its weight, in order to exert a desired level of pressure on the particles to be screened, without sacrificing flexibility and the automatic alignment on the particles.

With these measures, elongated particles can be effectively screened out, so that even individual particles in very small quantities of only 1% by weight, for example, can be screened out of the total quantity. The elongated particles drop out of the conveyor trough 12 at the end of the screen 18 and are collected by the receptacle 26.

Using a sheet 114 as the cover 42 offers the advantage of automatic adjustment, because the sheet rests on the particles by force of gravity, so that an adjustment to the extension of the particles perpendicular to the plane spanned by the screen 18 is made. In addition to this, the weight of the sheet 114 ensures that the particles cannot be erected in the manner described above.

In place of a sheet 114, a plate 44 may also be used, as is illustrated in principle in FIG. 6. In this case, a cover 48 extends above the screen 18 and is capable of pivoting around an axis 46, which extends transversely to the longitudinal axis of the screen in the intake area of the screen 18. This also results in a self-regulating adjustment to the particles being conveyed along the screen 18.

The plate 44 is curved at the intake side, providing an intake funnel 48 for the particles to be fed in. In the area of the intake funnel 48 is a closed base plate 19, which transitions into the first screen 18.

According to a further aspect of the invention, another screen 50 with a smaller mesh width is connected upstream from the screen 18 with the cover 42 (FIG. 2). In this case, the screens 18 and 50 can be provided in a screening device. The screens 18, 50 can extend outward from a vibrating screen trough, which can run inclined from the horizontal, or from a horizontal vibrating conveyor.

The principle of a vibrating conveyor 100 is illustrated in FIG. 1*b*. In this case, for elements that have been described in connection with FIG. 1*a*, the same reference symbols are used. The vibrating conveyor 100 comprises a housing 102 with a base 104, made of metal or abrasion-resistant plastic, for example, with the first screen 18, along which the particles 16, 20 are conveyed, extending in parallel to this.

The housing 102 is connected via leaf springs 106, 108 to a base plate 110, from which a magnet 112 projects, over which the base 104 and with it the housing 102 are drawn against the tension generated by the leaf springs 106, 108. Depending upon the frequency of the magnet 112, the housing 102 is placed in vibration, in order to transport the particles 16, along the screen 18. In this case, the particles 16, 20 are moved in trajectory parabolas 52, which should have an angle of preferably 30° to 60° from horizontal, especially approximately 45°, in order to enable the requisite conveyance. To prevent the elongated particles 38 from being turned upright far enough that they can fall through the mesh of the screen 18, the cover 44 extends above the screen 18 and the particles 16, 20, wherein said cover, according to the invention, is especially a sheet 114 which rests on the particles 16, 20 by force of gravity. Alternatively, a plate 44, which is capable of pivoting around an axis which extends perpendicular to the direction of transport, can be used, which plate also rests on the particles 16, 20 by force of gravity.

Regardless of whether a plate 44 or a sheet 114 is used to prevent the elongated particles from being erected far enough that they could fall through the mesh of the screen 18, an intake opening 48 between the sheet 114 or plate 44 and the screen 18 is provided at the intake side, which narrows gradually in the direction of transport, in other words it is quasi V-shaped in cross-section. In the area of the intake opening 48 is the closed surface 19, which then transitions into the screen 18.

The second screen 50, which preferably has a mesh width ranging from 0.3 mm to 1 mm, preferably from 0.5 mm to 0.8 mm, is used to screen out fine dust and particulate contaminants.

According to the teaching specified above, the particles conveyed along the second screen 50 are also moved by the vibration of the screen 50 in trajectory parabolas 52, and are therefore shaken, so that the friction of the particles against one another causes loosely adhering micrometer-sized particles to be released. These can then be suctioned through the screen 50 either downward (arrow 54) or upward (arrow 56). For this purpose, as illustrated in the schematic representation in FIG. 5, a suctioning device is provided, the width of which covers the screen mesh over its entire width b. Moreover, the suction opening should have a cross-section a×b, wherein 5 cm≦a≦the screen length. The greater a is, the better loosened miniature particles can be removed, and the lower the probability that granular particles which should be allocated to the product fraction will also be suctioned off.

To structure the suctioning device to be favorable in terms of energy, according to FIG. 5 a plurality of suctioning funnels 58, 60 are arranged above the screen 50, to suction off the miniature particles.

In the configuration of the conveyor system, it must be ensured that the particles having the lowest possible kinetic energy strike the walls, to prevent the undesired abrasion of material.

In this case, the speed at which the particles strike the walls of the vibration device should not exceed approximately 1 m/s.

The vibration frequency of the first or second screen can range from 10 Hz to 400 Hz, especially ranging from 50 Hz to 60 Hz. The transport speed of the particles along the first or second screen, respectively, should preferably range from 1 mm/s to 100 mm/s.

Typical dimensions of the first screen 18 and the second screen 50, respectively, are:

First screen 18: mesh width 2.0 mm to 3 mm, preferably 3.0 mm,

Second screen 50: mesh width 3 mm to 1 mm, preferably 0.5 mm.

With regard to the suctioning device for suctioning off the dust, the suctioning funnels 58, 60 are preferably situated above the screen 50. In this connection, the surface of each funnel 58, 60 should measure 20 mm×20 mm×70% (with 70% open screen surface). The suctioning force should be 3400 l/min. Furthermore, the suctioning surface and suctioning force should be adjusted to one another such that the suctioning speed is 0.1 to 3 m/s, preferably 0.5 m/s.

The following are typical dimensions for the particles and the product and/or elongated particle fraction:

Elongated particles: 1.5 mm≦L:B≦30 mm, wherein L measures approximately 3 mm to 10 mm.

Product fraction particles: 1.5 mm≦L:B≦10 mm, wherein L preferably ranges from 0.5 mm to 3 mm.

The aspect ratio L:B for undersize particles should be 1.5 mm≦L:B≦10 mm, with a length L of preferably L≦0.5 mm.

The invention claimed is:

1. A method for screening first particles out of a granulate comprising first and second particles by conveying the granulate along a first screen surface, wherein the first particles have an aspect ratio a1, wherein a1≧n:1, with n=2, 3, >3, and the dimensions of the second particles allow them to fall through the mesh of the first screen surface, wherein the granulate is conveyed along the screen surface between said surface and a cover which extends along the screen surface, and the cover causes the first particles to be aligned with their longitudinal axes extending along the screen surface, wherein the longitudinal extension of each first particle is greater than the mesh width of the screen which forms the first screen surface, and the longitudinal extension of the second particles is equal to or smaller than the mesh width, wherein a sheet, which rests on the particles by virtue of gravitational force, or a plate is used as the cover, which is capable of pivoting around an axis which extends transversely to the direction of transport of the granulate on the first screen surface in such a way that a gap which extends between the first screen surface and the cover is adjusted based upon the size and/or shape of the particles, and wherein the particles are conveyed along the first screen by means of oscillation or vibration of the first screen.

2. A method according to claim 1, wherein a sheet having a surface weight GF, with 5 mg/cm$^3$≦GF 150 mg/cm$^2$, is used as the sheet.

3. A method according to claim 1, wherein a sheet having a thickness dF, with 100 μm≦dF≦3 mm, is used as the sheet.

4. A method according to claim 1, wherein the first screen surface is set at an angle α, wherein 0°≦α≦60°, especially 0°≦α≦20°, in relation to the horizontal.

5. A method according to claim 1, wherein the cover borders at the screen intake side an intake opening to the screen, which narrows gradually in the direction of transport.

6. A method according to claim 1, wherein before being conveyed over the first screen surface, the granulate is conveyed over a second screen surface, over and/or under which and/or via which large surface miniature particles, especially dust particles, are removed.

7. A method according to claim 6, wherein the miniature particles are suctioned off above and/or below the second screen surface via suction through one or more suction openings, which preferably extend over the entire width of the screen surface.

8. A method according to claim 7, wherein as the total suction opening, an opening is used which has a cross-section a×b, with 5 cm≦a≦, wherein b=the width of the screen surface and 1=the length of the screen surface.

9. A method according to claim 1, wherein a screen having a mesh width of between 2 mm and 5 mm is used as the screen for the first screen surface.

10. A method according to claim 6, wherein a screen having a mesh width of between 0.3 mm and 1 mm, especially between 0.5 mm and 0.8 mm, is used as the screen for the second screen surface.

11. A method according to claim 1, wherein, before being placed upon the first screen surface, the granulate is dropped vertically past a suction opening.

12. A method according to claim 1, wherein crushed polysilicon blanks are used as the granulate.

13. A method according to claim 1, wherein a wafer scrap comprising silicon is used as the granulate.

14. A method according to claim 1, wherein semiconductor material such as silicon, germanium, GaAs, GaP, CdS, CdTe, $CuInSe_2$ and other compound semiconductors of the III-V, II-VI types, but also materials such as $SiO_2$ as the base material for the production of quartz, glasses, and ceramic materials such as SiC, $Al_2O_3$, $Si_3N_4$ and other materials which are processed as granulate are used as the granulate.

15. A device (10) for screening out particles (16, 20, 38) having a predetermined longitudinal extension measurement x, comprising at least one first screen (18) defining a surface and having a mesh width y, wherein the first screen, having a mesh width y, with y<x, is covered by a cover (42, 44), the particles can be conveyed between the cover and the first screen along said screen, and the effective gap width ds between the cover and the first screen is ds<x, wherein the cover (42) that covers the first screen (18), which can be placed in oscillation or vibration, is a sheet (114) which rests, by virtue of gravitational force, upon the particles (16, 20, 38) being conveyed on the first screen, or a plate (44) which is capable of pivoting around an axis (46) which extends in the area of the transverse edge of the first screen (18) at the intake side, in such a way that a gap which extends between the first screen surface and the cover is adjusted based upon the size and/or shape of the particles.

16. A device according to claim 15, wherein the cover (42) borders at the intake side an intake opening (48) at the intake side, which narrows gradually in the direction of transport of the particles (16, 20).

17. A device according to claim 15, wherein the sheet (114) has a thickness dF, with 100 μm≦dF≦3 μm.

18. A device according to claim 15, wherein the sheet (117) has a surface weight GF, with 5 mg/cm$^2$≦GF 150 mg/cm$^2$.

19. A device according to claim 15, wherein the cover (42) rests in a self-adjusting manner on the particles (16, 20, 38) being conveyed on the first screen (18).

20. A device according to claim 15, wherein the first screen (18) forms an angle $\alpha$ with the horizontal.

21. A device according to claim 20, wherein the angle $\alpha$ measures $0° \leqq \alpha \leqq 60°$, especially $0° \leqq \alpha \leqq 20°$.

22. A device according to claim 15, wherein a second screen (50) is connected upstream from the first screen (18).

23. A device according to claim 22, wherein a suctioning device (58, 60) is positioned above and below the second screen (50).

24. A device according to claim 23, wherein the suctioning device (58, 60) extends along the entire width of the second screen (50).

25. A device according to claim 22, wherein the suctioning device (58, 60) which extends along the second screen (50) has a cross-section a×b, with 5 cm$\leqq$a$\leqq$1, wherein b=the width of the second screen (50) and 1=the length of the second screen.

26. A device according to claim 22, wherein the first screen (18) and the second screen (50) originate from a shared vibration device.

27. A device according to claim 26, wherein the vibration device has a magnetic vibrator.

28. A device according to claim 15, wherein the first screen has a mesh width y, with 2 mm$\leqq$y$\leqq$5 mm.

29. A device according to claim 22, wherein the second screen (18) has a mesh width z, with 0.3 mm$\leqq$z$\leqq$1 mm, especially 0.5 mm$\leqq$z$\leqq$0.8 mm.

30. A device according to claim 15, wherein at least the first screen (18) originates from a vibrating screen trough or a horizontal vibrating conveyor (100).

* * * * *